US009583846B2

(12) United States Patent
Ohsaka

(10) Patent No.: US 9,583,846 B2
(45) Date of Patent: Feb. 28, 2017

(54) METHOD OF CONNECTING A CABLE WITH A CABLE CONNECTOR

(71) Applicant: DAI-ICHI SEIKO CO., LTD., Kyoto (JP)

(72) Inventor: Junji Ohsaka, Tokyo (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 330 days.

(21) Appl. No.: 14/260,780

(22) Filed: Apr. 24, 2014

(65) Prior Publication Data

US 2014/0345127 A1 Nov. 27, 2014

(30) Foreign Application Priority Data

May 22, 2013 (JP) ..... 2013-107587

(51) Int. Cl.
*H01R 9/03* (2006.01)
*H01R 43/28* (2006.01)

(52) U.S. Cl.
CPC ..... *H01R 9/038* (2013.01); *H01R 43/28* (2013.01); *Y10T 29/49174* (2015.01)

(58) Field of Classification Search
CPC ..... H01R 4/18; H01R 43/048
See application file for complete search history.

(56) References Cited

FOREIGN PATENT DOCUMENTS

| | | | | |
|---|---|---|---|---|
| CN | 1985102325 | A | * | 4/1986 |
| EP | 5377790 | B1 | * | 11/1994 |
| JP | 5041262 | A | * | 2/1993 |
| JP | 5084051 | U | * | 11/1993 |
| JP | 8096899 | A | * | 4/1996 |
| JP | 2007-048696 | A | | 2/2007 |
| JP | 2007048696 | A | * | 2/2007 |
| JP | 2008-269840 | A | | 11/2008 |
| JP | 2008269840 | A | * | 11/2008 |

* cited by examiner

*Primary Examiner* — Carl Arbes
(74) *Attorney, Agent, or Firm* — Studebaker & Brackett PC

(57) ABSTRACT

A method of connecting a cable with a cable connector comprises the steps of mounting a signal transmitting contact on a housing of a cable connector, said signal transmitting contact being formed to have an intersecting portion, an inclined portion and mutually opposite crooked portions forming a slit, forming an annular groove on an insulator covering a core wire in a cable, engaging the annular groove on the cable with the crooked portions so that the core wire appearing in the annular groove is pressed into the slit, and causing a part of the insulator of the cable positioned to demarcate the annular groove to be pushed by the inclined portion of the signal transmitting contact to move for projecting from a top end of the cable toward the outside so that the core wire appearing in the annular groove is put in press-contact with the slit.

3 Claims, 8 Drawing Sheets

METHOD OF CONNECTING A CABLE WITH A CABLE CONNECTOR

BACKGROUND OF THE INVENTION

Field of the Invention

The present invention relates generally to a method of connecting a cable with a cable connector, and more particularly to an improvement in a method of connecting a cable which has a core wire covered with an insulator with a cable connector which has one or more signal transmitting contacts, with each of which the core wire of the cable is electrically connected.

Description of the Prior Art including Information disclosed Under 37 CFR 1.97 and 37 CFR 1.98

There has been proposed to use often a cable connector with which a cable, such as a coaxial cable having a core wire, an inner insulator covering the core wire, a grounding conductor surrounding the inner insulator and the core wire, and an outer insulator covering the grounding conductor, is electrically connected when a plurality of electrical parts, electrical devices or electrical apparatus are mutually connected through the cable for transmitting signals or the like between the electrical parts, electrical devices or electrical apparatus. Such a cable connector is provided with signal transmitting contacts made of conductive material, with each of which the core wire of the cable is connected.

In the cable connectors proposed previously to be electrically connected with the cable, it is usual that the cable is electrically connected with the cable connector by means of a soldering method wherein the core wire of the cable is soldered to the signal transmitting contact provided in the cable connector. However, when the cable is electrically connected with the cable connector by means of the soldering method, especially in a case the core wire of the cable is selected to be extremely thin and thereupon the signal transmitting contact is provided to be extremely small in the cable connector, such problems that a troublesome operation with scrupulous care is required for soldering the core wire of the cable with the signal transmitting contact provided in the cable connector, it is very difficult to control correctly an appropriate quantity of each of a solder and a flux to be used, the cable is damaged by heat generated by the soldering, and so on, are raised.

Accordingly, for avoiding the above-mentioned problems, there has been also proposed previously a method of connecting a cable with a cable connector wherein a signal transmitting contact provided in the cable connector is so deformed into a predetermined shape that the core wire of the cable is electrically connected with the signal transmitting contact without the soldering method, as disclosed in, for example, the Japanese patent application published before examination under publication number 2007-048696 (hereinafter, referred to as published patent document 1) or the Japanese patent application published before examination under publication number 2008-269840 (hereinafter, referred to as published patent document 2).

In the case where such a previously proposed method as mentioned above is put into practice, in a cable connector which has a housing made of insulating material and a plurality of signal transmitting contacts mounted to stand on the housing and with which a plurality of cables are to be connected electrically, each of the signal transmitting contacts is provided with a forked portion formed into a pair of protrusions opposite to each other at a top end thereof. Then, when the cable is electrically connected with the cable connector, first an insulator covering a core wire of the cable is partially stripped from the core wire and the core wire of the cable bared partially is put between the protrusions of the forked portion at the top end of the signal transmitting contact of the cable connector. Next, the forked portion of the signal transmitting contact with the core wire bared partially and put between the protrusions is so deformed by external force exerted thereon as to cause the protrusions to come close to each other. Thereby, in case of ideal, the core wire bared partially is tightly held between the protrusions of the forked portion at the top end of the signal transmitting contact to be electrically connected with the signal transmitting contact. Consequently, it can be expected that the core wire of the cable is stably connected electrically with the signal transmitting contact of the cable connector without the soldering method.

When such previously proposed method of connecting the cable with the cable connector as disclosed in the published patent document 1 or 2, in which the core wire of the cable bared partially is put between the protrusions of the forked portion at the top end of the signal transmitting contact of the cable connector and then the forked portion of the signal transmitting contact is so deformed by external force exerted thereon as to cause the protrusions to come close to each other so that the core wire of the cable bared partially is held by the protrusions to be electrically connected with the signal transmitting contact of the cable connector, is put in practical use, it is feared that the following problems are raised.

In general, the core wire of the cable is formed into a twisted conductive string made by twisting a plurality of conductive fine lines. In the method of connecting the cable with the cable connector disclosed in the published patent document 1 or 2 and put in practical use, the twisted conductive string constituting the core wire of the cable is crushed to become disentangled conductive fine lines when the core wire is tightly held between the protrusions of the forked portion at the top end of the signal transmitting contact of the cable connector. As a result, the electrical connection of the core wire of the cable with the signal transmitting contact of the cable connector is made unstable to be lacking in certainty.

Further, in the case where the method of connecting the cable with the cable connector disclosed in the published patent document 1 or 2 is put in practice, each of the signal transmitting contacts mounted to stand on the housing of the cable connector is formed on an end portion of a metallic plate member to have the forked portion formed into the protrusions opposite to each other at the top end thereof. The thickness of the metallic plate member is subjected to a limit in proportion to the size of the signal transmitting contact and therefore the metallic plate member constituting the signal transmitting contact is unavoidably selected to be relatively thin Consequently, for example, if the external force exerted on the forked portion of the signal transmitting contact for deforming the same to cause the protrusions to become close to each other acts in an inappropriate direction sifted slightly from an appropriate direction, the signal transmitting contact is lacking in strength and comes down on the housing of the cable connector. As a result, the core wire of the cable cannot be correctly held between the protrusions constituting the forked portion of the signal transmitting contact.

BRIEF SUMMARY OF THE INVENTION

Accordingly, it is an object of the present invention to provide a method of connecting a cable having a core wire covered with an insulator, such as a coaxial cable, with a cable connector having one or more signal transmitting contacts, with each of which the core wire is electrically connected, which avoids the aforementioned disadvantages encountered with the prior art.

Another object of the present invention is to provide a method of connecting a cable having a core wire covered with an insulator, such as a coaxial cable, with a cable connector having one or more signal transmitting contacts, with each of which the core wire is electrically connected, by which the core wire of the cable can be appropriately and surely connected electrically with the signal transmitting contact of the cable connector with relatively easy operations without a soldering method.

A further object of the present invention is to provide a method of connecting a cable having a core wire formed into a twisted conductive string made by twisting a plurality of conductive fine lines and covered with an insulator, such as a coaxial cable, with a cable connector having one or more signal transmitting contacts, with each of which the core wire is electrically connected, by which the core wire formed into the twisted conductive string can be securely and stably connected electrically with the signal transmitting contact of the cable connector in a condition wherein the twisted conductive string is appropriately held by the signal transmitting contact without being crushed to become disentangled conductive fine lines.

According to the present invention, as claimed in any one of claims, there is provided a method of connecting a cable with a cable connector, which comprises the steps of mounting a signal transmitting contact on a housing made of insulating material of a cable connector, said signal transmitting contact being formed by bending a conductive strip-shaped plate to have a basic plane portion put in a predetermined standard plane, an intersecting portion extending in a direction intersecting to the standard plane, an inclined portion extending in a direction inclined to the standard plane to face the intersecting portion, and a pair of crooked portions being opposite to each other to form a slit and shaped to contain a junction between the intersecting portion and the inclined portion, wherein the intersecting portion or the inclined portion is elongated from the basic plane portion, forming an annular groove on an insulator covering a core wire at an end portion of a cable having the core wire covered with the insulator to cause the core wire to appear in the annular groove, engaging the annular groove formed on the insulator of the cable with the crooked portions provided between the intersecting portion and the inclined portion of the signal transmitting contact so that the core wire appearing in the annular groove is pressed into the slit formed between the crooked portions, and causing a part of the insulator positioned at a top end of the cable for demarcating the annular groove to be pushed by the inclined portion of the signal transmitting contact to project from the top end of the cable toward the outside so that the core wire appearing in the annular groove is put in press-contact with the slit formed between the crooked portions to be electrically connected with the signal transmitting contact.

When the method thus proposed in accordance with the present invention is put in practice, the signal transmitting contact which is formed by bending the conductive strip-shaped plate to have the basic plane portion put in the predetermined standard plane, the intersecting portion extending in the direction intersecting to the standard plane, the inclined portion extending in the direction inclined to the standard plane to face the intersecting portion and the crooked portions being opposite to each other to form the slit and shaped to contain the junction between the intersecting portion and the inclined portion, wherein the intersecting portion or the inclined portion is elongated from the basic plane portion, is mounted on the housing of the cable connector, and the annular groove is so formed on the insulator covering the core wire at the end portion of the cable as to cause the core wire to appear in the annular groove. On that occasion, for example, a width of the annular groove is selected to be larger than a distance from an outer surface of the intersecting portion of the signal transmitting contact to an outer surface of the inclined portion of the signal transmitting contact measured at a first position close by the junction between the intersecting portion and the inclined portion and to be smaller than a distance from the outer surface of the intersecting portion to the outer surface of the inclined portion measured at a second position remote beyond the first position from the junction between the intersecting portion and the inclined portion.

Then, the annular groove formed on the insulator of the cable is so engaged with the crooked portions forming the junction between the intersecting portion and the inclined portion as to press the core wire appearing in the annular groove into the slit formed between the crooked portions and thereby the part of the insulator positioned at the top end of the cable for demarcating the annular groove is pushed by the inclined portion of the signal transmitting contact to project from the top end of the cable toward the outside so that the core wire appearing in the annular groove is put in press-contact with the slit to be electrically connected with the signal transmitting contact.

When the method proposed as described above in accordance with the present invention is put in practice for connecting a cable having a core wire covered with an insulator, such as a coaxial cable, with a cable connector provided with one or more signal transmitting contacts arranged on a housing thereof, the signal transmitting contact of the cable connector is formed, as mentioned above, by bending the conductive strip-shaped plate to have the basic plane portion put in the predetermined standard plane, the intersecting portion extending in the direction intersecting to the standard plane, the inclined portion extending in the direction inclined to the standard plane to face the intersecting portion, and the crooked portions being opposite to each other to form the slit and shaped to contain the junction between the intersecting portion and the inclined portion, wherein the intersecting portion or the inclined portion is elongated from the basic plane portion, and mounted on the housing of the cable connector. Then, the cable which has been subjected to a process for forming the annular groove on the insulator covering the core wire at the end portion of the cable so that the core wire appears in the annular groove, is put in a condition in which the annular groove formed on the insulator of the cable is engaged with the crooked portions of the signal transmitting contact of the cable connector in such a manner that the core wire appearing in the annular groove is pressed into the slit formed between the crooked portions, and a part of the insulator of the cable positioned at a top end of the cable for demarcating the annular groove is pushed by the inclined portion of the signal transmitting contact to move for projecting from the top end of the cable toward the outside so that the core wire appearing in the annular groove is put in press-contact with the slit to be electrically connected with the signal transmitting contact.

Under such a situation, in the case where the width of the annular groove is selected, as mentioned above, to be larger than the distance from the outer surface of the intersecting portion of the signal transmitting contact to the outer surface of the inclined portion of the signal transmitting contact measured at the first position close by the junction between the intersecting portion and the inclined portion and to be smaller than the distance from the outer surface of the intersecting portion to the outer surface of the inclined portion measured at the second position remote beyond the first position from the junction between the intersecting portion and the inclined portion, when the annular groove formed on the insulator of the cable is engaged with the crooked portions of the signal transmitting contact and thereby the core wire appearing in the annular groove is pressed into the slit formed between the crooked portions, a condition in which the part of the insulator of the cable positioned at the top end of the cable for demarcating the annular groove is pushed by the inclined portion of the signal transmitting contact to project from the top end of the cable toward the outside is obtained without any particular and fine adjustments on the position of the annular groove to the crooked portions of the signal transmitting contact.

Since the part of the insulator of the cable positioned at the top end of the cable for demarcating the annular groove is pushed by the inclined portion of the signal transmitting contact to project from the top end of the cable toward the outside when the core wire appearing in the annular groove is pressed into the slit formed between the crooked portions to be put in press-contact with the slit, even if the core wire of the cable is constituted with a twisted conductive string made by twisting the conductive fine lines, the twisted conductive string constituting the core wire is prevented from being crushed to become disentangled conductive fine lines by the portion of the insulator of the cable pushed to project from the top end of the cable toward the outside when the cable is pressed into the slit formed between the crooked portions to be put in press-contact with the slit. Consequently, the core wire of the cable constituted with the twisted conductive string is securely and stably connected electrically with the signal transmitting contact of the cable connector in such a manner that the twisted conductive string constituting the core wire is not subjected to being crushed to become disentangled conductive fine lines.

Further, since the signal transmitting contact of the cable connector is formed to have the basic plane portion put in the predetermined standard plane, the intersecting portion extending in the direction intersecting to the standard plane, the inclined portion extending in the direction inclined to the standard plane to face the intersecting portion, and the crooked portions being opposite to each other to form the slit and shaped to contain the junction between the intersecting portion and the inclined portion, wherein the intersecting portion or the inclined portion is elongated from the basic plane portion, the crooked portions of the signal transmitting contact are prevented from being undesirably deformed or shifted in position and thereby the core wire of the cable pressed into the slit formed between the crooked portions to be put in press-contact with the slit is appropriately and stably held by the crooked portions.

As a result, with the method according to the present invention, when the cable having the core wire covered with the insulator, for example, the coaxial cable, is electrically connected with the cable connector provided with one or more signal transmitting contacts arranged on the housing thereof, the core wire of the cable can be appropriately and surely connected electrically with the signal transmitting contact of the cable connector with relatively easy operations without a soldering method. Further, when the cable having the core wire formed into the twisted conductive string made by twisting the conductive fine lines and covered with the insulator is electrically connected with the cable connector having one or more signal transmitting contacts arranged on the housing thereof, the core wire formed into the twisted conductive string can be securely and stably connected electrically with the signal transmitting contact of the cable connector in a condition wherein the twisted conductive string is appropriately held by the signal transmitting contact without being crushed to become disentangled conductive fine lines.

The above, and other objects, features and advantages of the present invention will become apparent from the following detailed description taken in conjunction with the accompanying drawings.

DETAILED DESCRIPTION OF THE INVENTION

Figure 1:
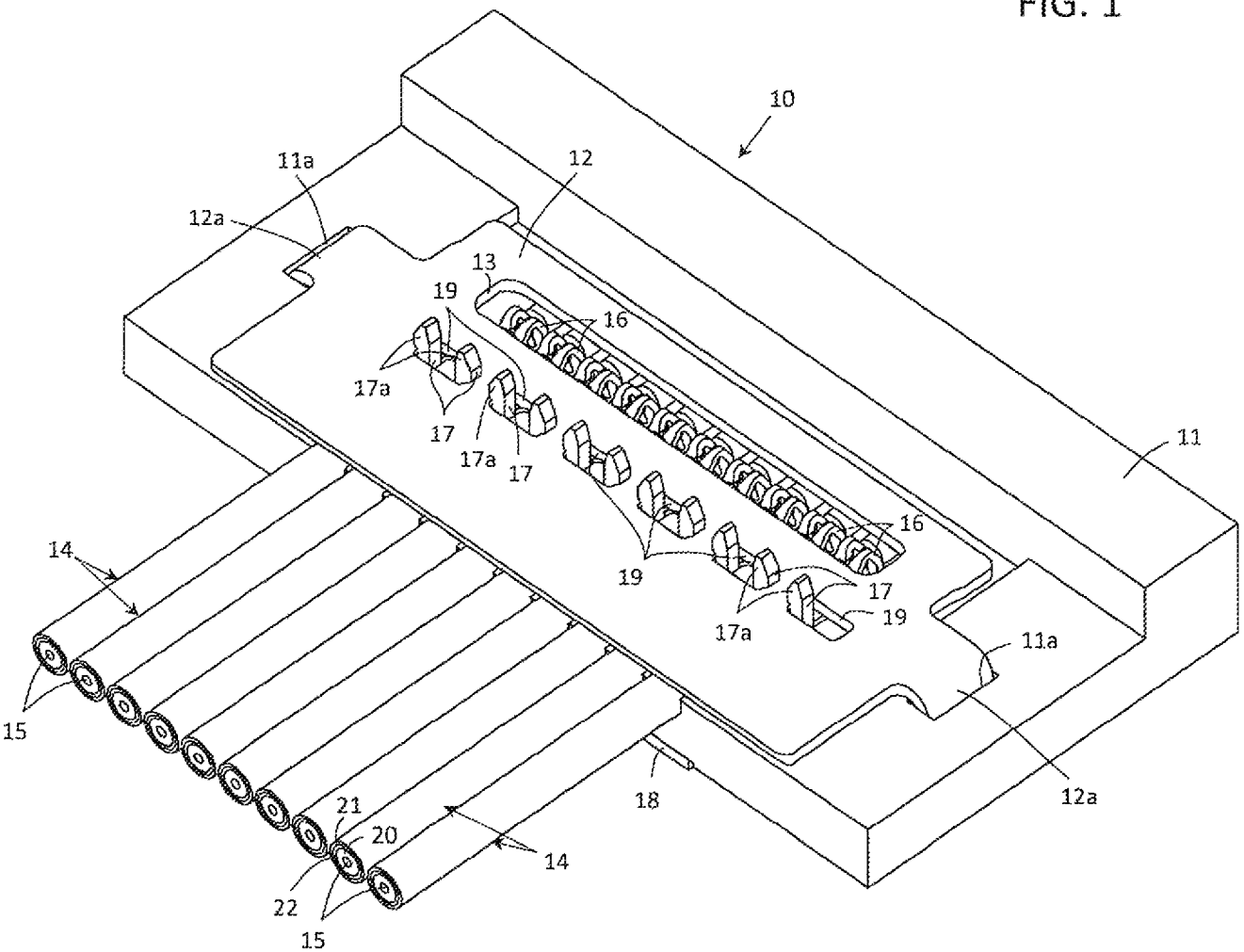
FIG. 1 is a schematic perspective view showing a cable connector and a plurality of cables connected with the cable connector by means of an embodiment of method according to the present invention.
Figure 2:
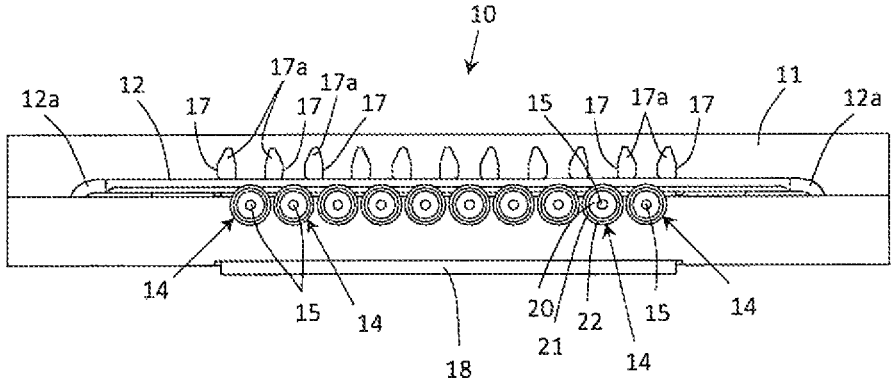
FIG. 2 is a schematic front view showing the cable connector and the cables connected with the cable connector by means of the embodiment of method according to the present invention.
Figure 3:
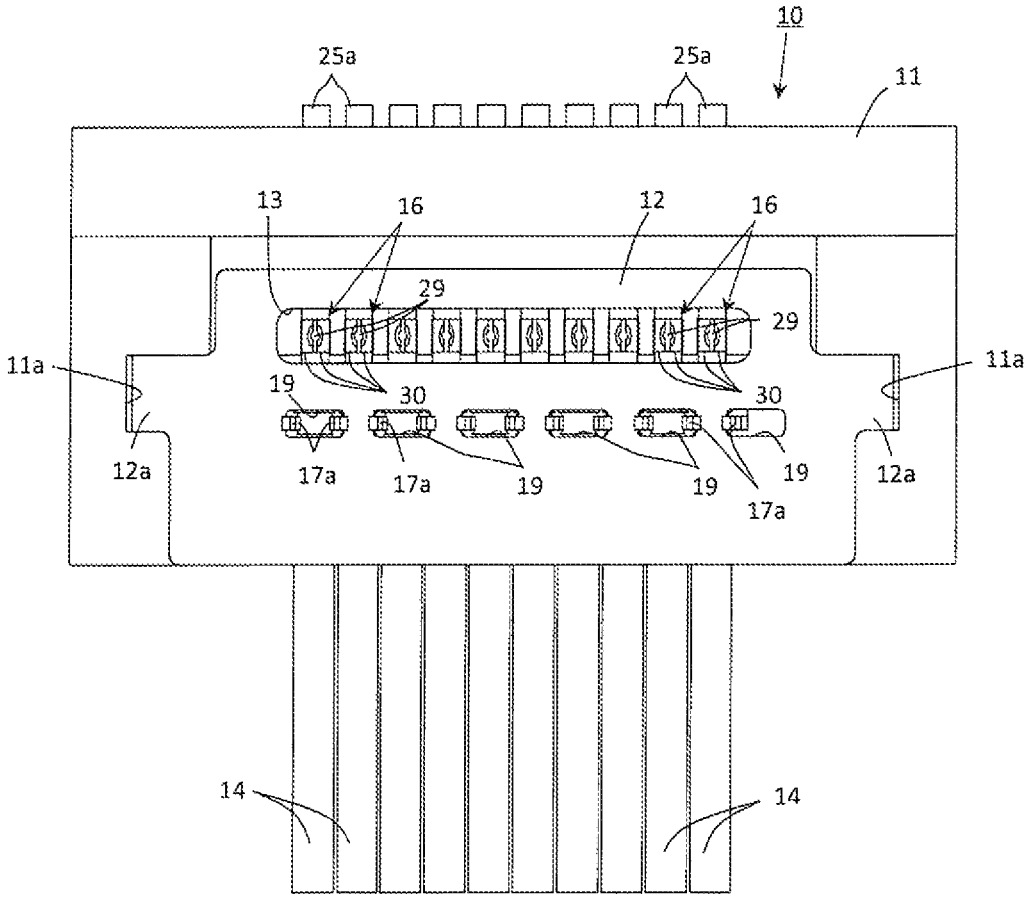
FIG. 3 is a schematic plan view showing the cable connector and the cables connected with the cable connector by means of the embodiment of method according to the present invention.

Each of FIGS. 1 to 3 shows a cable connector 10 and a plurality of cables 14 connected electrically with the cable connector by mean of an embodiment of method of connecting a cable with a cable connector according to the present invention.

Referring to FIGS. 1 to 3, the cable connector 10 has a housing 11 made of insulating material and a conductive cover 12 attached to the housing 11 to cover partially the inside of the housing 11. The conductive cover 12 is provided thereon with an opening 13 which elongates in a longitudinal direction of the housing 11 and through which a plurality of signal transmitting contacts 16 arranged in the housing 11 along the longitudinal direction of the housing 11 are peering out of the conductive cover 12.

The cables 14 are so arranged in parallel with one another along the longitudinal direction of the housing 11 as to form a board-shaped cable-aggregate on the whole. Each of the cables 14 has a core wire 15, an inner insulator 20 covering the core wire 15, a grounding conductor 21 surrounding the inner insulator 20 and the core wire 15 and an outer insulator 22 covering the grounding conductor 21 so as to constitute a coaxial cable. The core wire 15 of the cable 14 is electrically connected with the signal transmitting contact 16 of the cable connector 10.

A ground contact member 18 on which a plurality of cover holding members 17 are provided for engaging with the conductive cover 12 to hold the same is also attached to the housing 11 to be opposite to the conductive cover 12 with a board-shaped portion of the housing 11 put between the ground contact member 18 and the conductive cover 12. Each of the cover holding members 17 is planted on the ground contact member 18 to pass through the board-shaped portion of the housing 11 and extend to the conductive cover 12 with a top end 17*a* thereof passing through a corresponding one of holes 19 formed on the conductive cover 12 to the outside of the conductive cover 12. The top end 17*a* of the cover holding member 17 constitutes an engaging portion for engaging with a part of the conductive cover 12 surrounding the hole 19 to hold the conductive cover 12.

Figure 4:
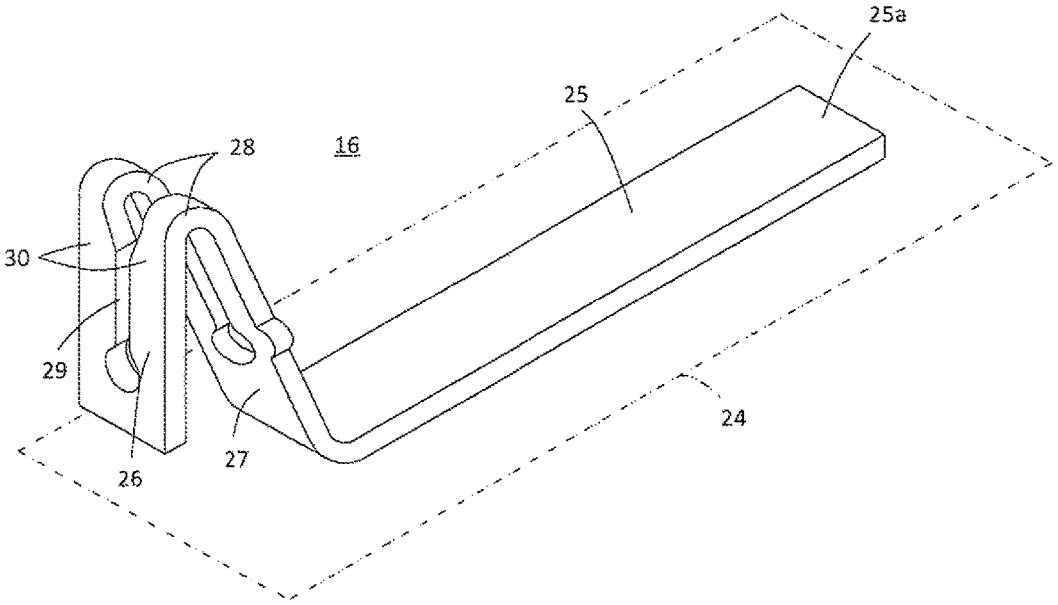
FIG. 4 is a schematic perspective view showing a signal transmitting contact contained in the cable connector shown in FIGS. 1 to 3.

As shown in FIG. 4, each of the signal transmitting contacts 16 is formed by bending a conductive strip-shaped plate of phosphor bronze to have a basic plane portion 25 put in an imaginary standard plane 24, an intersecting portion 26 extending in a direction intersecting to the imaginary standard plane 24 so as to be, for example, substantially perpendicular to the basic plane portion 25, and an inclined portion 27 extending in a direction inclined to the imaginary standard plane 24 to face the intersecting portion 26. The inclined portion 27 is elongated to be bent from the basic plane portion 25 and further almost folded back to be connected with the intersecting portion 26. A pair of junctions 28 for connecting the inclined portion 27 with the intersecting portion 26 are provided between the intersecting portion 26 and the inclined portion 27 to project from the imaginary standard plane 24. Incidentally, it is also possible to constitute a structure in which the inclined portion 27 is separated from the basic plane portion 25 and the intersecting portion 26 is elongated to be bent from the basic plane portion 25 in place of the structure in which the inclined portion 27 is elongated to be bent from the basic plane portion 25.

The signal transmitting contact 16 is further provided, in addition to the basic plane portion 25, the intersecting portion 26 and the inclined portion 27, with a pair of crooked portions 30 shaped to contain the junctions 28 between the intersecting portion 26 and the inclined portion 27. The crooked portions 30 are opposite to each other to form a slit 29 extending from the intersecting portion 26 to the inclined portion 27. A middle portion of the slit 29 is shaped into a slender opening between the junctions 28 through so that the core wire 15 of the cable 14 can be easily pressed into the slit 29 through the slender opening. Each of mutually opposite end portions of the slit 29 is shaped into an expanded opening for receiving the core wire 15 of the cable 14 pressed into the slit 29 to hold the same. Further, an end of the basic plane portion 25 of the signal transmitting contacts 16 forms a connecting terminal 25*a*.

As shown in FIG. 3, the connecting terminal 25*a* formed at the end of the basic plane portion 25 of the signal transmitting contacts 16 extends from the inside to the outside of the housing 11. A plurality of pairs of the crooked portions 30 each forming the slit 29 provided respectively on the signal transmitting contacts 16 are arranged along the longitudinal direction of the housing 11 at a position corresponding to the opening 13 formed on the conductive cover 12 to peer through the opening 13 out of the conductive cover 12 out of the conductive cover 12.

When the cables 14 are electrically connected with the cable connector 10 as described above by means of the embodiment of method according to the present invention, first, the signal transmitting contacts 16 are mounted on the housing 11 of the cable connector 10 to be arranged along the longitudinal direction of the housing 11 and the ground contact member 18 is so attached to the housing 11 that the cover holding members 17 planted on the ground contact member 18 passes through the board-shaped portion of the housing 11 to be arranged along the longitudinal direction of the housing 11. Thereby, the plural pairs of the crooked portions 30 each forming the slit 29 provided respectively on the signal transmitting contacts 16 are arranged in parallel with the arrangement of the cover holding members 17 with a predetermined space between the arrangement of the plural pairs of the crooked portions 30 and the arrangement of the cover holding members 17, as show in FIG. 5 which shows the cable connector 10 having the housing 11 from which the conductive cover 12 is removed and the cables 14 provided to be connected with the cable connector 10 by means of the embodiment of method according to the present invention.

Figure 5:
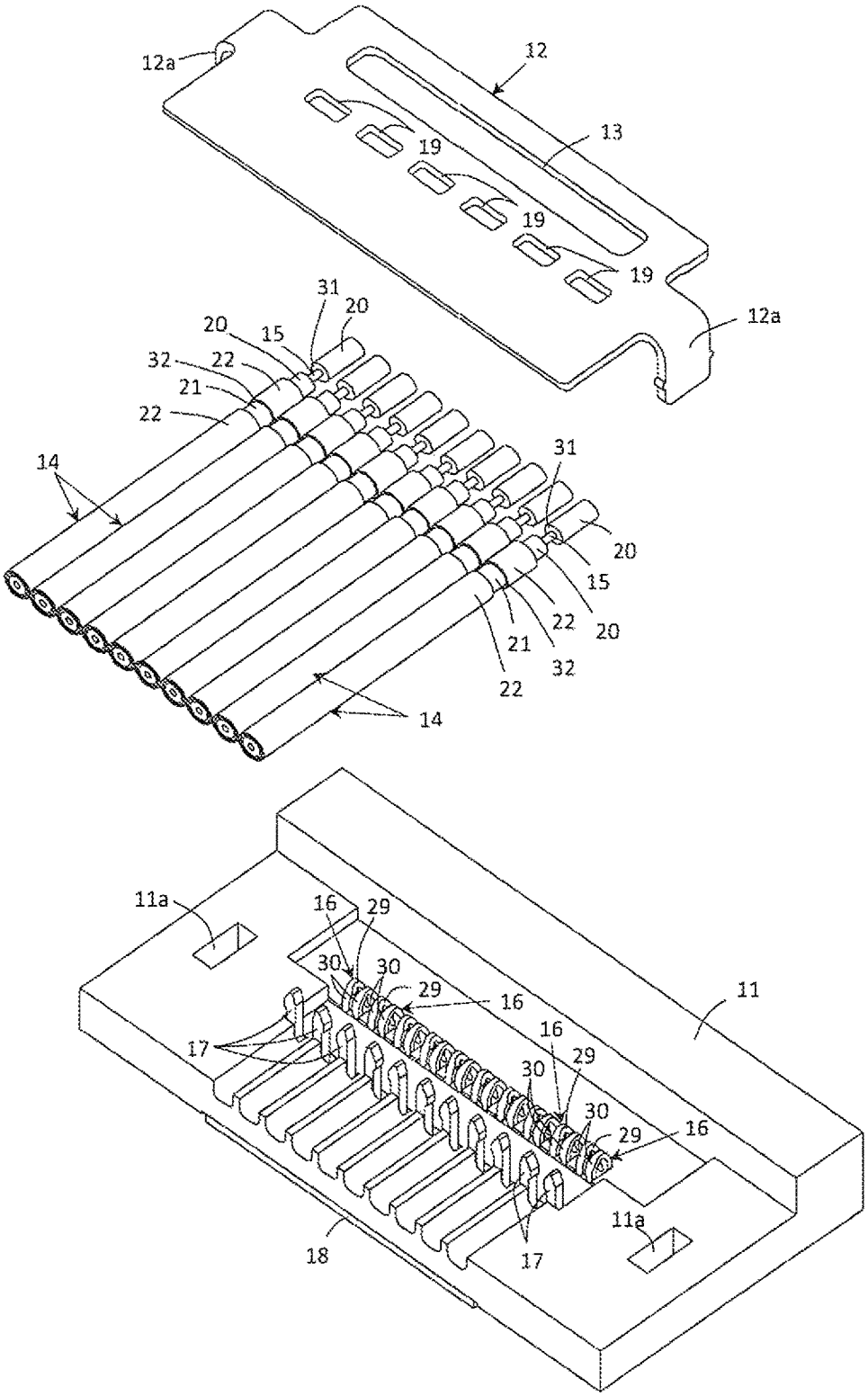
FIG. 5 is a schematic perspective view showing the cable connector having a housing made of insulating material and a conductive cover removed from the housing and the cables provided to be connected with the cable connector by means of the embodiment of method according to the present invention.

In addition, an end portion of each of the cables 14 is subjected to another process in which an annular groove 31 is formed on the inner insulator 20 covering the core wire 15 so that the core wire 15 is caused to appear in the annular groove 31 and another annular groove 32 is formed on the outer insulator 22 covering the grounding conductor 21 so that the grounding conductor 21 is caused to appear in the annular groove 32, as shown in FIG. 5. On that occasion, a space between the annular groove 31 formed on the inner insulator 20 to cause the core wire 15 to appear therein and the annular groove 32 formed on the outer insulator 22 to cause the grounding conductor 21 to appear therein is selected to correspond to the space between the arrangement of the plural pairs of the crooked portions 30 and the arrangement of the cover holding members 17.

Figure 6:
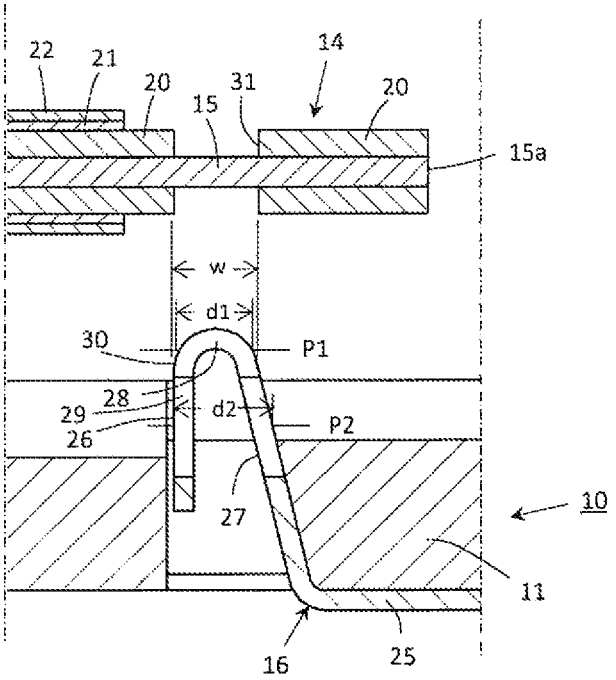
FIG. 6 is a schematic partial cross-sectional view used for explaining a relationship in size between a portion of a signal transmitting contact of the cable connector and the width of an annular groove formed on the cable provided to be connected with the cable connector by means of the embodiment of method according to the present invention.

Further, when the annular groove 31 is formed on the inner insulator 20 covering the core wire 15, for example, as shown in FIG. 6, a width w of the annular groove 31 is selected to be larger than a distance d1 from an outer surface of the intersecting portion 26 of the signal transmitting contact 16 to an outer surface of the inclined portion 27 of the signal transmitting contact 16 measured at a first position P1 close by the junction 28 between the intersecting portion 26 and the inclined portion 27 and to be smaller than a distance d2 from the outer surface of the intersecting portion 26 to the outer surface of the inclined portion 27 measured at a second position P2 remote beyond the first position p1 from the junction 28 between the intersecting portion 26 and the inclined portion 27.

Figure 7:
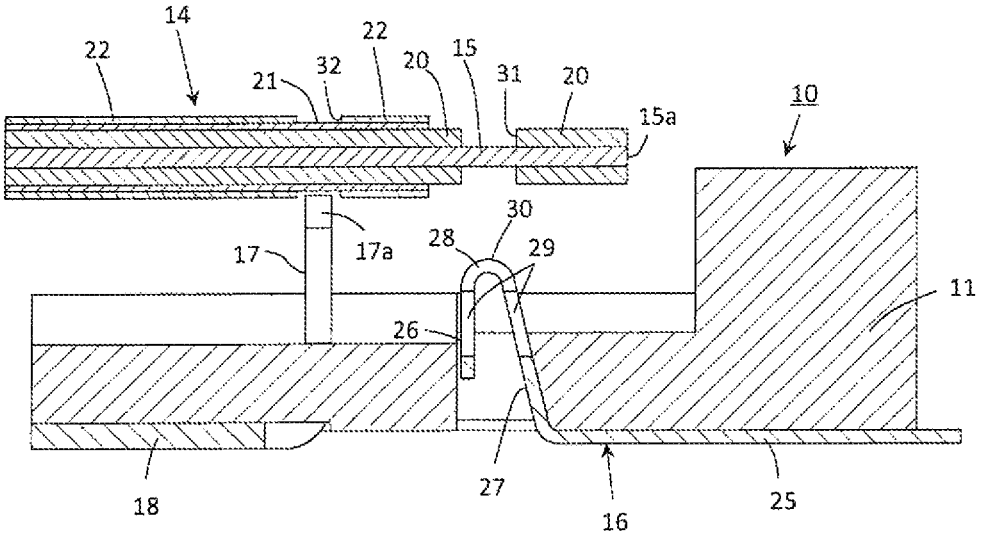
FIGS. 7 to 9 are schematic partial cross-sectional views used for explaining the steps of the embodiment of method according to the present invention.

Next, as shown in FIG. 7, each of the cables 14, the end portion of which has been subjected to the process in which the annular groove 31 is formed on the inner insulator 20 covering the core wire 15 and the annular groove 32 is formed on the outer insulator 22 covering the grounding conductor 21, is placed to be opposite to a corresponding one of the signal transmitting contacts 16 arranged in the housing 11 and a corresponding one of the cover holding members 17 planted on the ground contact member 18 of the cable connector 10. On that occasion, the annular groove 31 on the cable 14 is positioned to correspond to one of the pairs of the crooked portions 30 of the signal transmitting contact 16 and the annular groove 32 on the cable 14 is positioned to correspond to the cover holding member 17.

Then, the cables 14 placed to be opposite to the signal transmitting contact 16 and the cover holding member 17 is moved to the signal transmitting contact 16 and the cover holding member 17. Thereby, the annular groove 31 formed on the inner insulator 20 of the cable 14 is engaged with the crooked portions 30 shaped to contain the junction 28 between the intersecting portion 26 and the inclined portion 27 of the signal transmitting contact 16 so that the core wire 15 appearing in the annular groove 31 is pressed into the slit 29 formed between the crooked portions 30 and the annular groove 32 formed on the outer insulator 22 of the cable 14 is engaged with the cover holding member 17 planted on the ground contact member 18 so that the grounding conductor 21 appearing in the annular groove 32 is put in press-contact with the cover holding member 17, as shown in FIG. 8.

Figure 8:
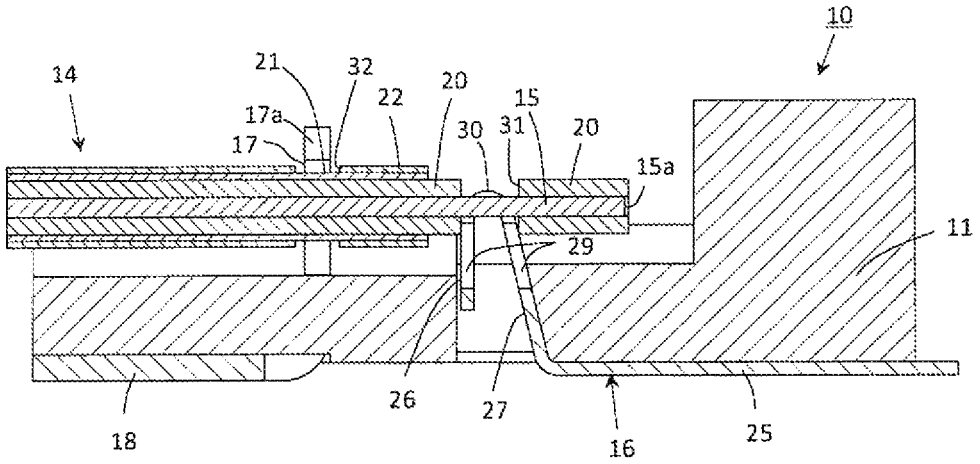

When the annular groove 31 formed on the inner insulator 20 of the cable 14 is engaged with the crooked portions 30 shaped to contain the junction 28 between the intersecting portion 26 and the inclined portion 27 of the signal transmitting contact 16 so that the core wire 15 appearing in the annular groove 31 is pressed into the slit 29 formed between the crooked portions 30, in the case where the width w of the annular groove 31 is selected to be larger than the distance d1 from the outer surface of the intersecting portion 26 of the signal transmitting contact 16 to the outer surface of the inclined portion 27 of the signal transmitting contact 16 measured at the first position P1 close by the junction 28 between the intersecting portion 26 and the inclined portion 27 and to be smaller than the distance d2 from the outer surface of the intersecting portion 26 to the outer surface of the inclined portion 27 measured at the second position P2 remote beyond the first position P1 from the junction 28 between the intersecting portion 26 and the inclined portion 27, a part of the inner insulator 20 of the cable 14 positioned at a top end of the cable 14 for demarcating the annular groove 31 is pushed by the inclined portion 27 of the signal transmitting contact 16 to move for projecting from the top end of the cable 14 toward the outside after the annular groove 31 engaged with the crooked portions 30 has moved to go over the first position P1 toward the second position P2, as shown in FIG. 8.

Incidentally, in the case where the width w of the annular groove 31 is not selected to be larger than the distance d1 measured at the first position P1 and to be smaller than the distance d2 measured at the second position P2 but selected to be larger than both of the distance d1 measured at the first position P1 and the distance d2 measured at the second position P2, if an inner end of the part of the inner insulator 20 of the cable 14 positioned at the top end of the cable 14 for demarcating the annular groove 31 is caused to come into contact with the inclined portion 27 of the signal transmitting contact 16 when the annular groove 31 formed on the inner insulator 20 of the cable 14 is engaged with the crooked portions 30 of the signal transmitting contact 16, the part of the inner insulator 20 of the cable 14 positioned at the top end of the cable 14 for demarcating the annular groove 31 can be pushed by the inclined portion 27 of the signal transmitting contact 16 to move for projecting from the top end of the cable 14 toward the outside.

Figure 9:
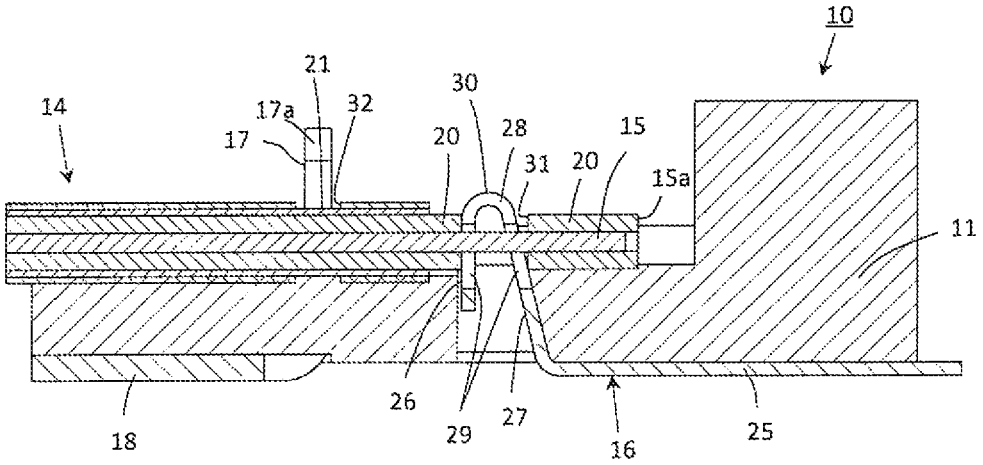

After that, the cable 14 provided with the annular groove 31 formed on the inner insulator 20 covering the core wire 15 and the annular groove 32 formed on the outer insulator 22 covering the grounding conductor 21, is further moved to the signal transmitting contact 16 and the cover holding member 17. Thereby, the portion of the inner insulator 20 of the cable 14 positioned at the top end of the cable 14 to constitute the annular groove 31 is continuously moved for projecting from the top end of the cable 14 toward the outside and the core wire 15 appearing in the annular groove 31 is put in press-contact with the slit 29 formed between the crooked portions 30 so that the core wire 15 of the cable 14 is electrically connected with the signal transmitting contact 16 of the cable connector 10, and at the same time, the grounding conductor 21 of the cable 14 is also electrically connected with the cover holding member 17 of the cable connector 10, as shown in FIG. 9.

Figure 10:
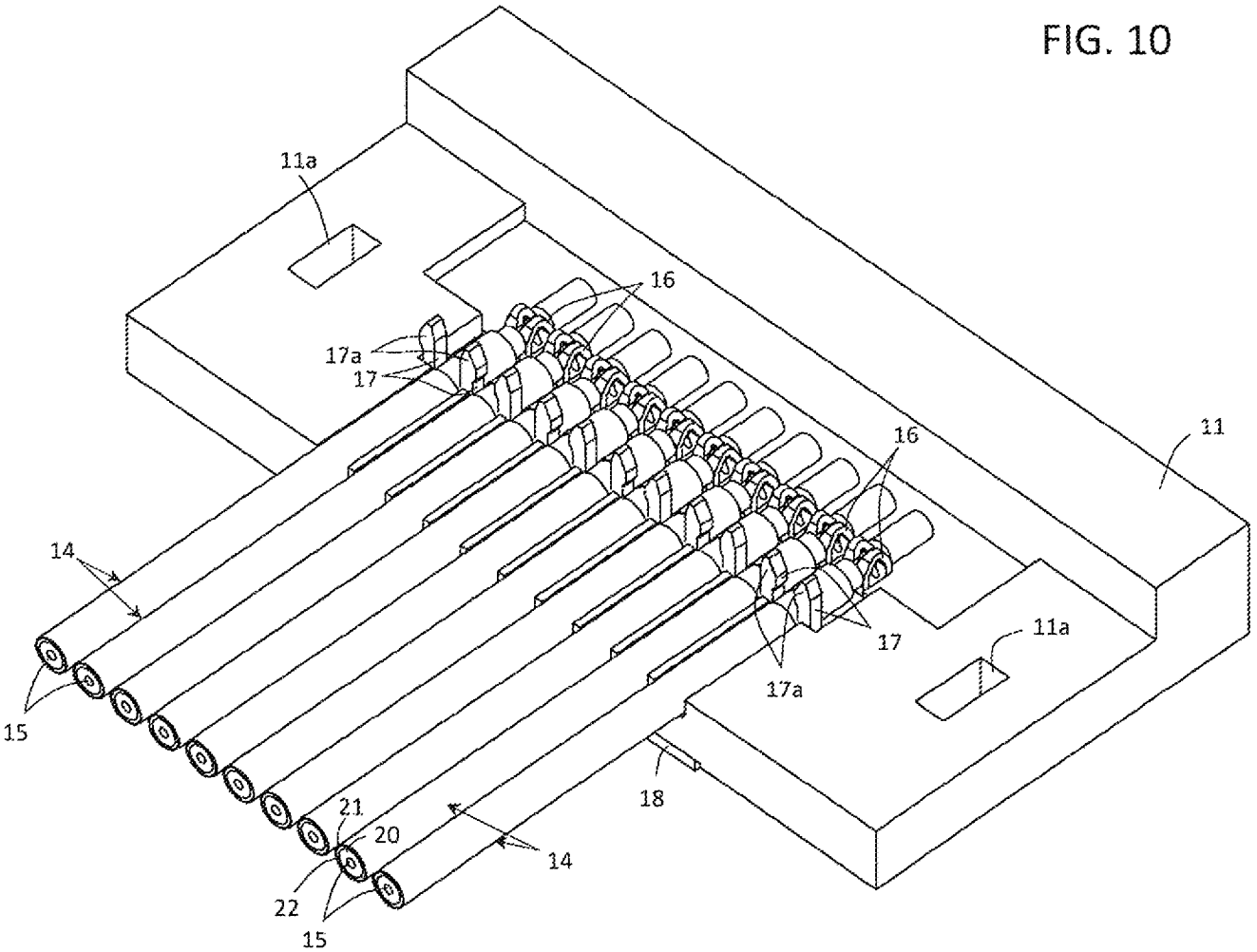
FIG. 10 is a schematic perspective view showing the housing of the cable connector and the cables fixed to the housing by some of the steps of the embodiment of method according to the present invention.
Figure 11:
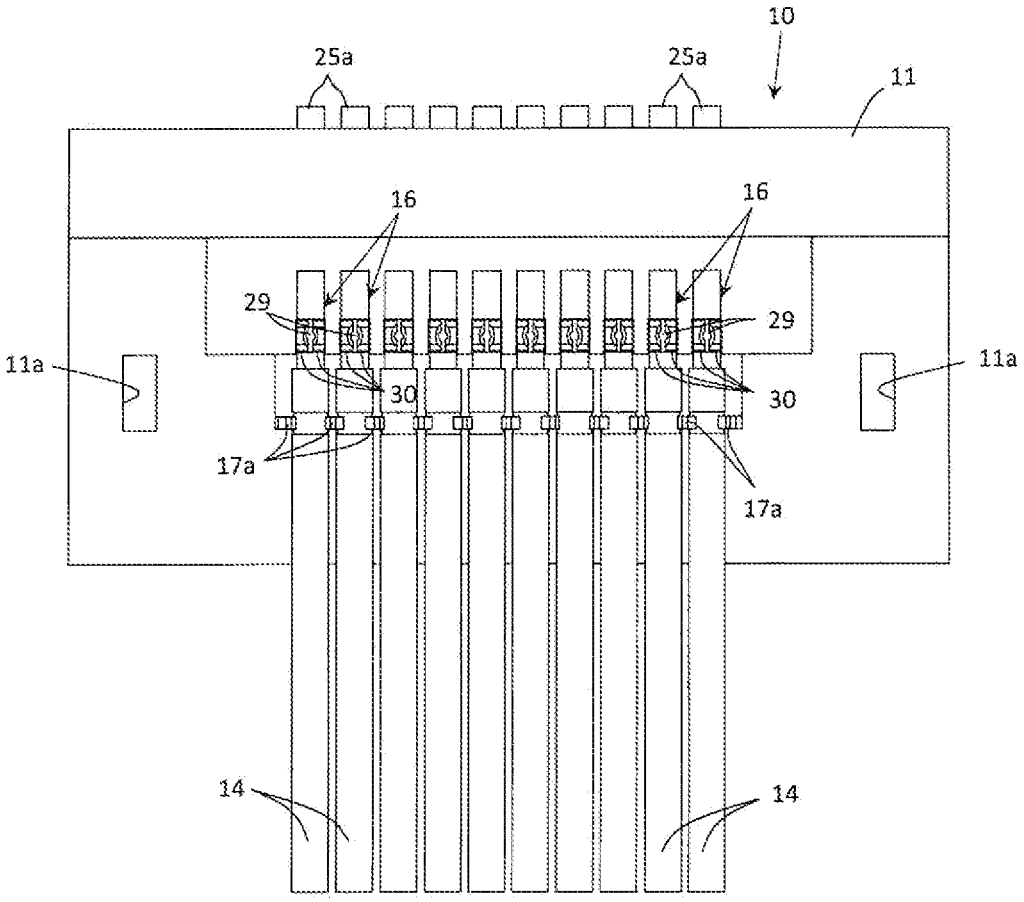
FIG. 11 is a schematic plan view showing the housing of the cable connector and the cables fixed to the housing by some of the steps of the embodiment of method according to the present invention.

As a result, as shown in FIGS. 10 and 11, the cables 14 are mounted on the housing 11 of the cable connector 10 in such a manner that the core wires 15 of the cables 14 are electrically connected respectively with the signal transmitting contacts 16 arranged in the housing 11 and the grounding conductors 21 of the cables 14 are electrically connected respectively with the cover holding members 17 planted on the ground contact member 18 of the cable connector 10.

Since the portion of the inner insulator 20 of the cable 14 positioned at the top end of the cable 14 to constitute the annular groove 31 is moved for projecting from the top end of the cable 14 toward the outside when the core wire 15 of the cable 14 appearing in the annular groove 31 is put in press-contact with the slit 29 formed between the crooked portions 30, as described above, even if the core wire 15 of the cable 14 is constituted with a twisted conductive string made by twisting the conductive fine lines, the twisted conductive string constituting the core wire 15 is prevented from being crushed to become disentangled conductive fine lines by the portion of the inner insulator 20 of the cable 14 pushed to move for projecting from the top end of the cable 14 toward the outside. Consequently, the core wire 15 of the cable 14 constituted with the twisted conductive string is securely and stably connected electrically with the signal transmitting contact 16 of the cable connector 10 in such a manner that the twisted conductive string constituting the core wire 15 is not subjected to being crushed to become disentangled conductive fine lines.

In addition, a top end of the core wire 15 of the cable 14 is covered and insulated by the portion of the inner insulator 20 moved for projecting from the top end of the cable 14 toward the outside so that the core wire 15 of the cable 14 is prevented from coming unwillingly into contact with external conductors or the like.

After the cables 14 have been mounted on the housing 11 of the cable connector 10 in such a manner as described above, the conductive cover 12 shown in FIG. 5 is attached to the housing 11 with a pair of engaging portions 12*a* provided thereon to engage respectively with a pair of receiving holes 11*a* formed on the housing 11 so as to cover the end portions of the cables 14 connected respectively with the signal transmitting contacts 16 and the cover holding members 17. In the conductive cover 12 attached to the housing 11, as shown in FIG. 1, each of the cover holding members 17 arranged on the housing 11 passes through a corresponding one of the holes 19 formed on the conductive cover 12, the top end 17*a* of each of the cover holding members 17 engages with the part of the conductive cover 12 surrounding the hole 19 to hold the conductive cover 12, and the crooked portions 30 of each of the signal transmitting contacts 16 arranged in the housing 11 are peering through the opening 13 formed on the conductive cover 12 out of the conductive cover 12. Further, portions of the conductive cover 12, between which the opening 13 elongates in the direction along which the signal transmitting contacts 16 are arranged and another portions of the conductive cover 12, between which the holes 19 are arranged in the direction along which the signal transmitting contacts 16 are arranged are caused to come into contact with a portion of the inner insulator 20 of each of the cables 14 close by the crooked portions 30 of the signal transmitting contact 16 and a part of the outer insulator 22 of each of the cables 14 close by the cover holding member 17 so as to press each of the cables 14 down to the housing 11. Thereby, a condition wherein the cables 14 are mounted on the housing 11 is stably maintained.

When the embodiment of method according to the present invention is put in practice for connecting the cables 14, each of which constitutes the coaxial cable, electrically with the cable connector 10, each of the cables 14 which has been subjected to the process for forming the annular groove 31 on the inner insulator 20 covering the core wire 15 at the end portion of the cable 14 so that the core wire 15 appears in the annular groove 31, is put in a condition in which the annular groove 31 formed on the inner insulator 20 of the cable 14 is engaged with the crooked portions 30 of the signal transmitting contact 16 of the cable connector 10 in such a manner that the core wire 15 appearing in the annular groove 31 is pressed into the slit 29 formed between the crooked portions 30 and the part of the inner insulator 20 of the cable 14 positioned at the top end of the cable 14 for demarcating the annular groove 31 is pushed by the inclined portion 27 of the signal transmitting contact 16 to move for projecting from the top end of the cable 14 toward the outside so that the core wire 15 appearing in the annular groove 31 is put in press-contact with the slit 29 to be electrically connected with the signal transmitting contact 16.

Under such a situation, in the case where the width w of the annular groove 31 is selected to be larger than the distance d1 from the outer surface of the intersecting portion 26 of the signal transmitting contact 16 to the outer surface of the inclined portion 27 of the signal transmitting contact 16 measured at the first position P1 close by the junction 28 between the intersecting portion 26 and the inclined portion 27 and to be smaller than the distance d2 from the outer surface of the intersecting portion 26 to the outer surface of the inclined portion 27 measured at the second position P2 remote beyond the first position P1 from the junction 28 between the intersecting portion 26 and the inclined portion 27, when the annular groove 31 formed on the inner insulator 20 of the cable 14 is engaged with the crooked portions 30 of the signal transmitting contact 16 and thereby the core wire 15 of the cable 14 appearing in the annular groove 31 is pressed into the slit 29 formed between the crooked portions 30, a condition in which the part of the inner insulator 20 of the cable 14 positioned at the top end of the cable 14 for demarcating the annular groove 31 is pushed by the inclined portion 27 of the signal transmitting contact 16 to move for projecting from the top end of the cable 14 toward the outside is obtained without any particular and fine adjustments on the position of the annular groove 31 to the crooked portions 30 of the signal transmitting contact 16.

Since the part of the inner insulator 20 of the cable 14 positioned at the top end of the cable 14 for demarcating the annular groove 31 is pushed by the inclined portion 27 of the signal transmitting contact 16 to move for projecting from the top end of the cable 14 toward the outside when the core wire 15 of the cable 14 appearing in the annular groove 31 is pressed into the slit 29 formed between the crooked portions 30 to be put in press-contact with the slit 29, even if the core wire 15 of the cable 14 is constituted with a twisted conductive string made by twisting the conductive fine lines, the twisted conductive string constituting the core wire 15 is prevented from being crushed to become disentangled conductive fine lines by the part of the inner insulator 20 of the cable 14 pushed to move for projecting from the top end of the cable 14 toward the outside when the cable 14 is pressed into the slit 29 formed between the crooked portions 30 to be put in press-contact with the slit 29. Consequently, the core wire 15 of the cable 14 constituted with the twisted conductive string is securely and stably connected electrically with the signal transmitting contact 16 of the cable connector 10 in such a manner that the twisted conductive string constituting the core wire 15 is not subjected to being crushed to become disentangled conductive fine lines.

Further, since the signal transmitting contact 16 of the cable connector 10 is formed to have the basic plane portion 25 put in the imaginary standard plane 24, the intersecting portion 26 extending in the direction intersecting to the imaginary standard plane 24, the inclined portion 27 extending in the direction inclined to the imaginary standard plane 24 to face the intersecting portion 26, and the crooked portions 30 being opposite to each other to form the slit 29 and shaped to contain the junction 28 between the intersecting portion 26 and the inclined portion 27, wherein the intersecting portion 26 or the inclined portion 27 is elongated from the basic plane portion 25, the crooked portions 30 of the signal transmitting contact 16 are prevented from being undesirably deformed or shifted in position and thereby the core wire 15 of the cable 16 pressed into the slit 29 formed between the crooked portions 30 to be put in press-contact with the slit 29 is appropriately and stably held by the crooked portions 30.

As a result, with the embodiment of method according to the present invention, when the cable 14 constituting the coaxial cable is electrically connected with the cable connector 10, the core wire 15 of the cable 14 can be appropriately and surely connected electrically with the signal transmitting contact 16 of the cable connector 10 with relatively easy operations without the soldering method. Further, when the cable 14 having the core wire 15 formed into the twisted conductive string made by twisting the conductive fine lines and covered with the inner insulator 20 is electrically connected with the cable connector 10, the core wire 15 formed into the twisted conductive string can be securely and stably connected electrically with the signal transmitting contact 16 of the cable connector 10 in a condition wherein the twisted conductive string is appropriately held by the signal transmitting contact 16 without being crushed to become disentangled conductive fine lines.

The invention claimed is:

1. A method of connecting a cable with a cable connector, which comprises the steps of:

mounting a signal transmitting contact on a housing made of insulating material of a cable connector, said signal transmitting contact being formed by bending a conductive strip-shaped plate to have a basic plane portion put in a predetermined standard plane, an intersecting portion extending in a direction intersecting to the standard plane, an inclined portion extending in a direction inclined to the standard plane to face the intersecting portion, and a pair of crooked portions being opposite to each other to form a slit and shaped to contain a junction between the intersecting portion and the inclined portion, wherein one of the intersecting portion and the inclined portion is elongated from the basic plane portion, forming an annular groove on an insulator covering a core wire at an end portion of a cable having the core wire covered with the insulator to cause the core wire to appear in the annular groove, engaging the annular groove formed on the insulator of the cable with the crooked portions provided between the intersecting portion and the inclined portion of the signal transmitting contact so that the core wire appearing in the annular groove is pressed into the slit formed between the crooked portions, and causing a part of the insulator positioned at a top end of the cable for demarcating the annular groove to be pushed by the inclined portion of the signal transmitting contact to move for projecting from the top end of the cable toward the outside so that the core wire appearing in the annular groove is put in press-contact with the slit formed between the crooked portions to be electrically connected with the signal transmitting contact.

2. A method according to claim 1, wherein a width of the annular groove is selected to be larger than a distance from an outer surface of the intersecting portion of the signal transmitting contact to an outer surface of the inclined portion of the signal transmitting contact measured at a first position close by the junction between the intersecting portion and the inclined portion and to be smaller than a distance from the outer surface of the intersecting portion to the outer surface of the inclined portion measured at a second position remote beyond the first position from the junction between the intersecting portion and the inclined portion when the annular groove is formed on the insulator of the cable.

3. A method according to claim 1 further comprising the steps of attaching a conductive cover for covering partially the housing and a ground contact member provided thereon with a cover holding member for holding the conductive cover to the housing so that the housing is put between the conductive cover and the ground contact member opposite to each other, and connecting electrically a grounding conductor provided for surrounding the core wire in the cable with the cover holding member provided on the ground contact member.

* * * * *